US005616928A

United States Patent [19]

Russell et al.

[11] Patent Number: 5,616,928

[45] Date of Patent: Apr. 1, 1997

[54] PROTECTING PERSONNEL AND THE ENVIRONMENT FROM RADIOACTIVE EMISSIONS BY CONTROLLING SUCH EMISSIONS AND SAFELY DISPOSING OF THEIR ENERGY

[76] Inventors: Virginia Russell, Buffalo, N.Y.; James W. Russell, administrator, 913 Arnett Dr., Newport News, Va. 23608

[21] Appl. No.: 909,410

[22] Filed: Jul. 7, 1992

Related U.S. Application Data

[63] Continuation-in-part of Ser. No. 327,415, Mar. 22, 1989, Pat. No. 5,149,494, which is a continuation of Ser. No. 30,041, Mar. 24, 1987, abandoned, which is a continuation of Ser. No. 426,824, Sep. 29, 1982, Pat. No. 4,663,115, which is a continuation-in-part of Ser. No. 933,529, Aug. 14, 1978, abandoned, which is a continuation of Ser. No. 781,503, Apr. 13, 1977, abandoned.

[51] Int. Cl.[6] ..... G21D 7/00

[52] U.S. Cl. ..... 250/515.1; 250/505.1; 376/320; 310/302; 429/5; 136/253

[58] Field of Search ..... 250/515.1, 505.1, 250/506.1; 376/320, 321, 288; 310/301, 302, 304, 305; 136/202, 253; 429/5, 15

[56] References Cited

U.S. PATENT DOCUMENTS

| | | | |
|---|---|---|---|
| 2,837,666 | 6/1958 | Linder | 310/3 |
| 2,847,585 | 8/1958 | Christian | 310/3 |
| 2,961,415 | 11/1960 | Axelrad | 250/515.1 |
| 3,591,860 | 7/1971 | Sampson | 310/3 |
| 3,939,366 | 2/1976 | Ato et al. | 310/3 R |
| 4,178,524 | 12/1979 | Ritter | 310/304 |
| 4,663,115 | 5/1987 | Russell | 376/320 |
| 5,122,332 | 6/1992 | Russell | 376/288 |
| 5,149,494 | 9/1992 | Russel | 310/320 |

*Primary Examiner*—Jack I. Berman
*Assistant Examiner*—Kiet T. Nguyen
*Attorney, Agent, or Firm*—Peter F. Casella

[57] ABSTRACT

An apparatus for protecting personnel and the environment from harmful emissions of radiation from a source thereof includes a plurality of shielding parts so located as to be in the path of the radioactive emissions and to absorb them so that an electrical potential difference between the shielding parts is established, due to different absorptions of radiation by them, a variable electrical load for consuming electrical power at a location remote from the radioactive source, and electrical conductors communicating the variable electrical load with such shielding parts. Although the invention is primarily intended for protecting personnel and the environment against emissions from radiation sources, such as radioactive wastes, it is also useful for shielding other sources of harmful radiated emissions. Also within the invention are processes for protecting personnel and the environment against radiation hazards.

19 Claims, 2 Drawing Sheets

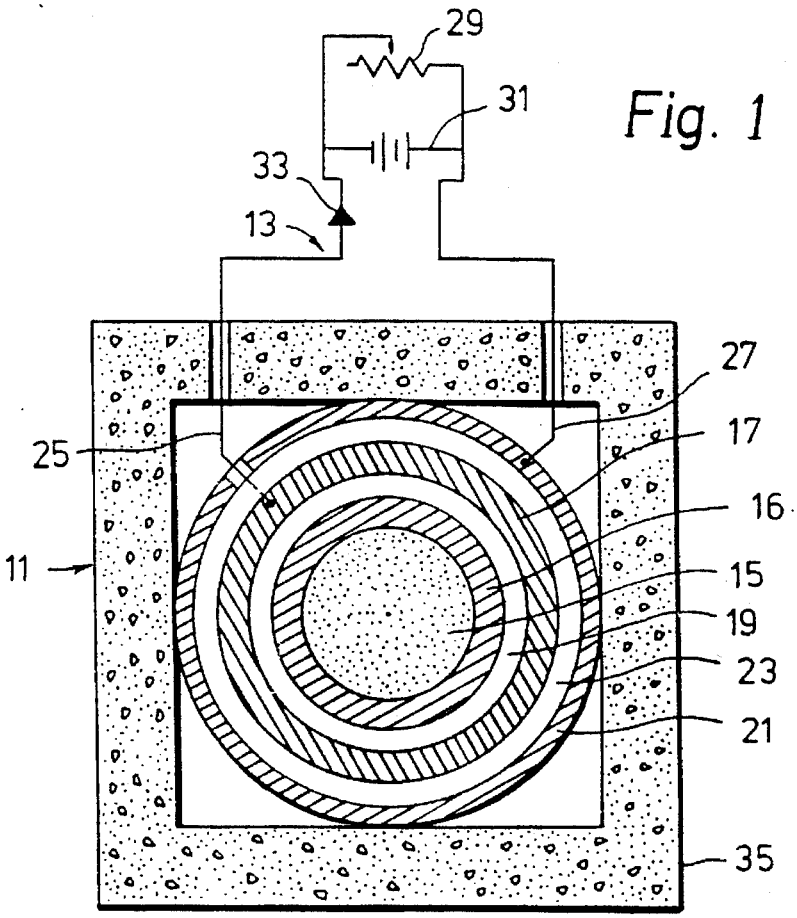
Fig. 1
Fig. 2
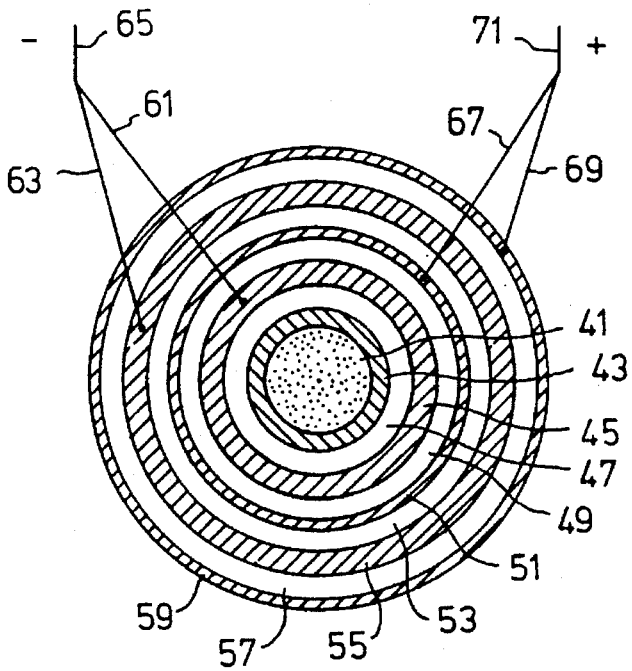

PROTECTING PERSONNEL AND THE ENVIRONMENT FROM RADIOACTIVE EMISSIONS BY CONTROLLING SUCH EMISSIONS AND SAFELY DISPOSING OF THEIR ENERGY

RIGHTS TO INVENTION

All rights to the invention are invested in Applicant. No government assistance has been received.

This application is a continuation-in-part of Ser. No. 07/327,415, filed Mar. 22, 1989, which now is U.S. Pat. No. 5,149,494, which is a continuation of Ser. No. 07/030,041, filed Mar. 24, 1987, abandoned, which is a continuation of Ser. No. 06/426,824 filed Sep. 29, 1982, which now is U.S. Pat. No. 4,663,115, which is a continuation-in-part of Ser. No. 05/933,529, filed Aug. 14, 1978, abandoned, which is a continuation of Ser. No. 05/781,503, filed Apr. 13, 1977, abandoned.

FIELD OF THE INVENTION

This application relates to an apparatus for protecting personnel and the environment from emissions of harmful radiation, such as radioactive emissions emanating from radioactive waste. More particularly, it relates to such an apparatus which includes a shielding part or parts so located as to be in a path of the radiated emissions and to absorb such emissions, at least in part, so that the electrical potential of the shielding part will be changed, and electrically conductive means for connecting such shielding part with a sink through an electrical load so as to consume the electrical energy generated and so as to remove the electrical charge from the shielding part, thereby enabling such part better to absorb additional radiation, and helping to stabilize the material of such part and prevent potentially explosive buildup of energy therein. The invention also relates to processes for protecting personnel and the environment from radiation.

DESCRIPTION OF RELATED ART

The closest references known such as U.S. Pat. No. 3,939,366 to Ato et al., No. 4,178,524 to Ritter, and an article in Chemical and Engineering News, Vol. 32, No. 7, at page 592, issued Feb. 15, 1954. The Ato et al. patent teaches the direct generation of electricity from radioactive materials by means of semiconductors. The Chemical and Engineering News article mentions a semiconductor crystal with an impurity in it to form a junction similar electrically to a junction in a junction transistor and mentions strontium-90 as a source of radiant energy. The Ritter patent is for a radioisotope photoelectric generator to produce electrical energy at a high voltages, e.g., 25,000 volts. Ritter intentionally builds up potential difference while in accordance with the present invention such build-up is prevented. Ritter specifies that his photon-producing radioactive source of energy must be a source of energy less than 1 million electron volts and Ritter teaches the use of pure isotopes, rather than mixtures of different radioactive material, such as are found in nuclear wastes. A very significant distinction between Ritter and the present invention is in the fact that Ritter is attempting to produce electricity and the object of the invention is to protect personnel and the environment from radioactive emissions. Ritter does not teach varying resistance to consume the energy of the emissions and his "load" may not be sufficient to handle a burst of energy. Ritter does not mention such protective function for his apparatus and the lead shielding of the Ritter apparatus, which has no part in the electrical functions thereof, is the means by which he prevents harmful radiation from the radioactive source from reaching any personnel and the environment. Certainly, the environment is not protected by Ritter's "battery". Thus, it is seen that the present invention is novel, useful and unobvious from the "prior art" mentioned.

For many years intensive efforts have been made to protect personnel and the environment from harmful radiations from various sources and in recent years extensive research has been performed in an effort to reduce the harmful effects of various radioactive wastes, especially mixed wastes, such as those from spent fuel rods used for power generation, and those known as "weapons wastes". Various treatments of such nuclear wastes that have been tried include calcining, gas diffusion, concentration, solidification, fusion and incorporation in vitreous matrices, synthetic organic polymers or inorganic sorbents. After concentration and "solidification" in a suitable matrix, as described above, such wastes are transported to disposal sites, such as salt domes, and are buried therein. Although such treatments and storage may seem to be comparatively safe, there is always the possibility that radiation and heat released by the decaying radioactive material will fracture the matrix, and earth movements and water flows could carry released radioactive materials away from the disposal site, to areas where they may be harmful to humans, animals, fish and the environment in general. The present invention provides a means for converting at least a portion of the harmful radiation from radioactive wastes (and from other sources of harmful radiated emissions) to environmentally acceptable, safe, and often useful form, and it does this at relatively low voltage and low temperature so that any danger of explosion is minimized. Thus, harmful radiation is converted to useful electrical power, although the object of this invention is to protect the environment, rather than to produce power. The removal of electrical energy from the radiation absorbing means of this invention promotes further absorption of such radiation and also improves the resistance of the absorbing means to deterioration by radiation. Utilization of pairs of electrically conductive absorber-converters in paths of the radiation, which absorbers are connected to a load to draw off electrical charges therefrom, is preferred, and the employment of pairs of such absorbers, connected to common conductors to carry electricity to the load, is a further preferred mode of the invention.

SUMMARY OF THE INVENTION

In accordance with the present invention an apparatus for protecting organisms and the environment from harmful emissions of radiation from a source thereof by shielding said organisms and the environment from at least a portion of such emissions comprises a plurality of shielding parts located so as to be capable of absorbing radiation emissions from the source thereof, with one such part being located farther away from the source than the other and with the shielding parts both being in the path of the same emissions, so that an electrical potential difference between such shielding parts is established, due to different absorptions of radiation by them, and electrical conductors communicating with such shielding parts and transmitting such difference in potential to a means for consuming electric power located remote from the radioactive source. In preferred embodiments of the invention the shielding parts are of electrically conductive materials, such as metals of different atomic numbers, separated by an insulator, e.g., epoxy resin, ceramic, mica, glass, air and means are present to induce initial charging of the shield(s) and to produce the resulting electric current. Also, it is often preferable for the shielding members to be in roughly spherical form and for pluralities of pairs of such shielding members to be used so that radiation passing through the first set(s) of members may be absorbed by subsequent set(s). In a broader aspect of the invention an electrically conductive shield acts to collect energy from harmful radiation and discharges such energy through an electrical load. The invention also relates to various processes for protecting humans and the environment and for reducing radioactivity.

BRIEF DESCRIPTIONS OF THE DRAWINGS

The invention will be readily understandable from the following description, taken in conjunction with the drawing, in which:

FIG. 1 is a schematic representation, substantially like a central vertical sectional view, of an apparatus of this invention;

FIG. 2 is a front vertical sectional view of a modification of a portion of the apparatus shown in FIG. 1;

DESCRIPTION OF THE PREFERRED EMBODIMENTS

Figure 3:
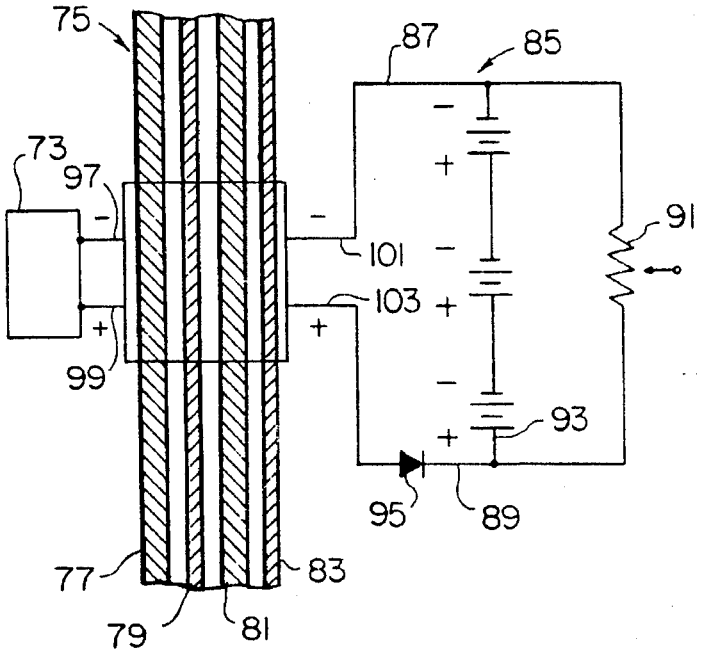
FIG. 3 is a schematic representation of a modified apparatus of this invention, partially in cross-section, in which plural shielding apparatuses are employed to consume the energy of radioactive material.

In FIG. 1 numeral 11 represents the emissions absorbing portion of an apparatus of this invention, and the remainder of the apparatus, for carrying off and consuming the energy generated in portion 11, is designated by numeral 13. In portion 11 radioactive waste material 15, suitably shaped in spherical form (although other forms may also be employed and held in a suitable interior container 16, preferably of compatible material, is positioned inside an inner spherical shell of electrically conductive material (such as aluminum), and is separated from such material by dielectric 19, which may be a suitable dielectric, solid or gaseous, e.g., alumina, mica, air. An enveloping sphere 21 surrounds sphere 17 and is separated from it by dielectric 23. Sphere 21 is preferably of an electrically conductive material, such as a metal of higher atomic number than the material of sphere shell 17. Suitable such materials are copper and silver, with copper normally being preferred, but other metals may also be used. When solid dielectrics are utilized they may be the sole means for separating the sphere but when gaseous dielectrics, such as air (or a high vacuum) are employed, mechanical means (not shown), preferably of electrically insulating material, will be employed. Electrical conductors 25 and 27, which will usually be insulated copper, and/or silver wires, conduct electricity to a variable resistance 29 and/or a battery 31. Diode 33 is provided to act as a check switch on current flow, preventing battery 31 from delivering electricity to part 11 of the apparatus. Other switches (not shown) may also be provided to separate the variable resistance and the battery from the rest of the system, if desired, and the variable resistance may be made automatically variable to draw a relatively small current, due to the difference in the electrical potentials of the spherical shells 17 and 21, drawing more current when the potential difference is sufficiently high and being of decreased resistance so as to allow and promote current flow when the potential difference is lower. Also, means may be provided for automatically reversing the polarity of the battery so as initially to stimulate or induce electrical current flow between spherical shells 17 and 21.

While spherical shells are shown, these may be of other suitable shapes, such as cylindrical, cubical, tetrahedronal and ellipsoidal too, and in some instances the shells may desirably be perforated to allow release (through suitable absorbers or safety means, not shown) of gaseous materials generated from the radioactive waste or generated by expansion of gases present, as heat is released from the waste. Sometimes the inner shell may be perforated to permit some radiant energy flow through such openings, as when plural pairs of shields or electrodes are employed, e.g., 4 to 200 concentric metal spheres, with separating dielectrics. In the illustration a single apparatus is illustrated but banks of such devices may be connected together, with the current produced flowing through single or multiple resistances and/or being employed to charge one or more batteries.

In FIG. 1 the nuclear waste is in a suitable metal container 16 but it is contemplated that other materials of construction may be employed and sometimes it can be omitted. Concrete enclosing container 35 encloses the waste, the container for the waste, and the pair of spherical shells of electrically conductive material, but other suitable exterior containers may also be utilized.

While this invention is not bound or limited by the following theory of operation, it is considered that alpha particles emitted by the radioactive waste (which usually is a complex mixture of various radioactive isotopes) tend to make the charge of the first metal absorber positive whereas beta particles and gamma rays, being more penetrating, tend to make the charge of the next contacted electrically conductive material negative, as illustrated in FIG. 1. When plural pairs of absorbers are employed the metals of low density will tend to be negative relative to the high density metals. Metals of low density, if sufficiently thick, will react with more beta particles reaching them than will metals of higher density because the high density metals, if sufficiently thin, will reflect some of the lower frequency radiation back to the more absorbing low density metal and transmit some to the next set of shielding levels. If the wastes emit gamma rays there should be several layers of combinations of insulator, low density conductor, insulator, high density conductor, etc. For example, aluminum and copper may be employed, as may be other metals and alloys, and combinations of metals (or alloys) outside the ranges specified in the Ritter patent. Magnesium, aluminum and/or titanium may be employed as the low atomic number metal, together with vanadium, chromium, manganese, iron, cobalt, nickel, copper or zinc as the higher atomic number metal. Similarly, magnesium or aluminum may be used with titanium. Also, for example, vanadium, chromium, manganese or iron may be used with cobalt, nickel, copper or zinc, with preference being to employing such combinations with atomic numbers further apart within such groups. Other such combinations that are useful include vanadium, chromium, manganese, iron, cobalt, nickel, copper or zinc with molybdenum, silver, tin, platinum, gold, mercury and/or lead. In some applications alloys or amalgams may be employed. Also, with respect to the higher atomic number materials, silver, cadmium and tin may be used with lead. Thus, while, within the broader aspects of this invention it is possible to utilize as the absorber or shield materials metals with atomic numbers below 23 in combination with those of atomic numbers above 46, it is also possible to utilize combinations of metals outside such ranges and still obtain the radiation absorbing and energy consuming effects desired.

In FIG. 2 heterogeneous nuclear waste 41, in a suitable metal container 43, is surrounded by concentric absorbing materials and dielectrics, all of which are in spherical shape conforming to the shape of waste 41 and container 43. Thus, between the container for the radioactive waste and the first radiation absorbing sphere 45 of electrically conductive material there is a dielectric layer or sphere 47 and subsequently, in order, about the sphere 45 are a spherical layer 49 of dielectric, another absorbing sphere 51 of electrically conductive material, another dielectric layer 53, another metal layer 55, a dielectric layer 57 and an outer metal layer 59. Spheres 45 and 55 are of aluminum or copper, as shown, and spheres 51 and 59 are of copper or lead, respectively. The same dielectric, mica, alumina or other suitable solid, or air, may be used between the various metal spheres. Of course, other shapes than spherical may also be employed. As illustrated, in normal operation spheres 45 and 55 will usually be relatively negative and spheres 51 and 59 will be relatively positive. Conductors 61 and 63 connect the "negative" potentials of spheres 45 and 55 to line 65, which line connects to an electrical power consuming part of the circuit, not shown herein, but like that of FIG. 1. Lines 67 and 69 act to transmit the "positive" potentials from parts 51 and 59 to line 71, which is also connected to the energy consuming parts of the circuit. Of course, lines 61, 63, 65, 67, 69 and 71 are insulated to avoid any short circuits. While only two sets of pairs of electrodes, shields, or electrically conductive spheres are illustrated in FIG. 2, a multiplicity of such pairs may also be employed. Also, container 43 and/or waste 41 may be connected to line 71.

In FIG. 3 there is shown a nuclear installation, battery or other source of electrical power 73, which also is a source of harmful radiation due to the presence therein of radioactive material. Numeral 75 designates a multilayered shield of alternating high Z and low Z metals, separated by dielectrics. For example, electrically conductive metal sheets 77 and 81 may be of a low Z material, such as aluminum, and sheets 79 and 83 may be of a higher Z material, such as copper or lead. Between the sheets are dieletric layers, which may be of suitable dielectric material, such as alumina, mica, silica, glass and in some cases, synthetic organic polymeric plastics. If gaseous materials are employed for the dielectric, air or high vacuum is usually preferred. Electrical connections of the more negative first and third layers and the more positive second and fourth layers and the insulated metal surface of source 73 be made to a power consuming portion of the circuitry, 85, which includes lines 87 and 89, a variable load 91, batteries to be charged, such as that at 93, and a diode 95 to prevent batteries from discharging through the radioactive source. As is seen from the drawing, voltages from energy converting device 73 and shield 75 may be combined via conductors 97 and 99, and 101 and 103 respectively. Thus, shielding 75 can protect humans and the environment from nuclear installation 73 and can be employed to help consume the radiation energy from the nuclear material in such installation. Of course, shielding 75 may be used to enclose the source of radiation 73 or may be employed to enclose and protect a "target" of such radiation, such as a room in which personnel are located, near the nuclear installation.

Figure 4:
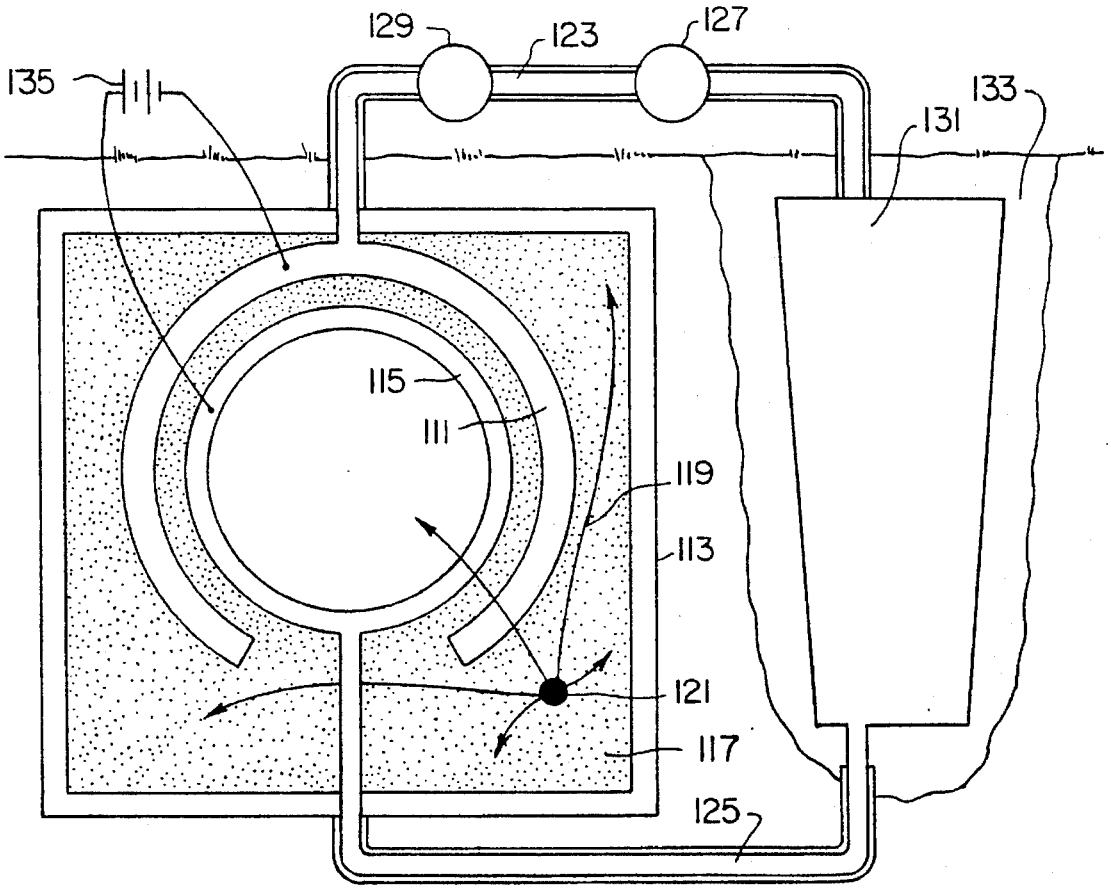
FIG. 4 is an elevational view, partially in cross-section, of another embodiment of the apparatus of this invention.

FIG. 4 illustrates another embodiment of the invention in which an aluminum electrode 111, or "shield", in the form of an empty truncated sphere, with a few small holes in it, and insulated from surrounding container 113, has another conductive sphere 115, made of copper or silver, inside it. Radioactive waste 117 is in the container surrounding the spheres, and arrows, such as that identified by numeral 119, show some paths of radioactive emissions from a particular location 121 of the radioactive material. Instead of aluminum, other conductive materials, preferably metals, can be used as the material of the outer sphere as long as they are stable at the temperature obtaining within container 113 and as long as they are dense enough to absorb alpha particles emitted from the heterogeneous nuclear waste. Among such materials may be mentioned magnesium, titanium, copper, iron, chromium and nickel. Outer shell 111 does not have to be spherical in shape but a sphere presents the greatest variety of directional surfaces and is an excellent target for emitted radiation. Inner electrode 115, preferably of silver or copper, may also be of other conductive metals, with the identity of its electrode material depending to some extent on that of the other electrode material. For example, it is preferred that "the high Z" and "low Z" metals should be at least five atomic members apart, more preferably at least ten atomic numbers apart and most preferably twenty or more atomic numbers apart. Also, relatively high and low Z materials may be employed. Thus, two "high Z" metals or alloys may be used so long as they are a sufficient atomic number difference apart and are operative in the present invention.

Electrical conductors 123 and 125, together with the outer shell source of electrical potential and the inner shell source of electrical potential, can be communicated through a load or resistance, such as that shown at 127, and the current flowing can be read by an ammeter, such as that at 129. Absorbing of alpha particles by conductors 123 and 125 may send a positive charge through the circuit but relatively high Z shield 115 will tend to be more charged than low Z 111 due to 111's greater photoelectron reactivity and its greater absorption of electrons. Also, as illustrated, the electrical potential from either of the metal spheres may be transmitted to a sink, represented by metal plate 131, in pond 133, which plate serves as a ground. At 135 is shown a battery which may be employed to induce the flow of electricity between the metal spheres or from the metal spheres to the metal plate 131. Switches for cutting off the auxiliary battery 135 are present, but are not illustrated in the drawing.

As is seen from the previous description the present process affects dangerous emissions from the heterogeneous radioactive or comparable radiation source, which are converted to electrical energy, which is consumed. Thereby radiation is removed from the environment and is changed to a harmless energy form. It is well known that huge sums of money have been expended in research efforts to solve nuclear waste storage problems but despite all such efforts no prior art disclosure taught the process of this invention. Prior art efforts were directed to containing the nuclear waste, usually after concentration thereof, by storing it in a container or matrix in a remote area or deep in the earth. Often shielding was utilized which, in effect, merely contains the radiation or is itself affected by absorption of such radiation. When containment is the only effect of the shielding dangerous energy levels can be produced and when conversion of the shielding material takes place due to energy absorption, the nature of the material may change, leading to deterioration thereof.

Before the present invention it was known that certain types of radiation could be converted into electrical energy (but many experts refused to believe that gamma rays could be so transformed). Still, the prior art did not teach the use of any of such conversion mechanisms for shielding the environment from dangerous emissions. In fact, such apparatuses could leak primary emissions and could generate dangerous secondary emissions. Also, for satisfactory operation of various prior art nuclear devices for producing electrical energy, such as that of the Ritter patent, purified sources of radioactivity had to be used, rather than heterogeneous wastes, such as usual nuclear wastes. The present invention allows the treatment and shielding of such wastes and also allows the protection of various sources of complex radioactive emissions, such as decommissioned nuclear plants, pools of highly radioactive materials, radioactive mill tailings, nuclear wastes being transported, nuclear wastes being processed, and stored solidified wastes that have been "vitrefied", encased in a synthetic organic resin, or embedded in ceramics or concrete.

The present invention also incorporates several safety features not suggested by the prior art. For example, by drawing off radiant energy from shield material the invention allows for stabilization of such material and thereby increases its shielding life. Also, whereas in the Ritter patent an object has been to build up high voltages, thus putting a strain on the shielding and increasing the danger of accident, such is not necessary nor is it an object of the present invention, which allows for regulation of the resistance to maintain a current flow and thereby to aid the conversion of radioactivity to electricity. In other words, there is no "back pressure" on the system due to any requirement to produce a high voltage, and the present apparatus acts as a safety valve, allowing the flow of more electricity in response to any flare-ups or sudden emissions of radioactivity.

The embodiment of the invention described uses form-retaining electrically conductive metal shields but such shields may also be made in the form of a flexible blanket which can be easily placed over a source of radiation or over a subject to be protected from such radiation. In such and other instances the intervening dielectric material, which will then preferably be a solid, may be molded or otherwise attached to the electrically conductive materials. Of course, in such blankets suitable conductors will be provided to carry off electricity from the shielding metals to an electrical load, where it is consumed.

In employing the invention modifications may be made depending on the particular type of waste being utilized and its state of "decay". If the predominant emission is of alpha particles the load should be across contacts with the first layer of shielding and the rest of the shielding. If the predominant emission is of beta rays it is considered best to have a high Z outermost shielding layer and/or a ground as one electrode and all the other layers as the other electrode. When gamma rays are the principal radiation it is considered best to employ thin layers of relatively high Z material with thicker layers of relatively low Z material, in repeating pairs, with the current flow being between such high Z and low Z layers. Usually the various shield layers are at different distances from the radioactive source but it is also within the invention to utilize different shield electrodes at the same distance from such source. For conversion of gamma rays to harmless electricity a honeycomb form of shielding is considered to be efficient, and it is also effective for absorption of beta rays. However, in some cases, as when the metal shields deteriorate after use (some reduced amount of deterioration may be observed) only a single type of metal shielding material may sometimes be best employed, with dependence being on direct conversion, photoelectricity, Compton effect and ion pair formation for conversion of the radiation energy. Normally, as when a source of radiation is aboveground, as in a decommissioned nuclear power plant, the shielding may have to be changed as time goes by. Such changing may also be dictated by the changing nature of the radiation source, and it will be preferable to utilize shieldings for greatest effects versus various types of radiation, for example, radioactive cobalt 60 during the first years after decommissioning, and isotopes of nickel and niobium many years later (each having different peak frequencies of radiation). As described, shields may be used around a nuclear reactor or installation, and above the installation they may be in staggered form to allow air circulation (but any air emitted will be filtered and monitored for leakage of radionuclides).

Liquid wastes may be shielded by means of the present invention, as may be radioactive wastes being transported in containers. Such containers may be made of shielding materials and the electrical load may be a part of the electrical system of the transporting vehicle. For example, the electricity generated from the waste being carried may be used to operate electric lights on a truck or trailer being employed, which lights will blink on and off to act as a warning that radioactive material is present.

The present invention is useful for protecting humans and the environment. Even if it had been known that electricity could be produced from heterogeneous radiation including gamma rays, such "new use" of such process would be patentable, especially in the absence of any suggestion thereof in the art. Especially in view of the long felt need for such a process and the great number of researchers attempting to invent it it is considered that the process was not merely inherent in the prior art and was not obvious to those of ordinary skill in such art.

Apparently the closest "prior art" to the present invention is U.S. Pat. No. 4,178,524, to Ritter. Ritter does not mention the employment of his apparatus to absorb radiation and protect the environment. In fact, he utilizes a lead housing to attenuate the radiation emitted by the source thereof. It may be inferred that the Ritter apparatus creates additional emissions. Ritter uses particular types of radioactive sources, emitting energies less than a million electron volts. Such radioactive sources of Ritter appear to be relatively pure isotopes, not heterogeneous nuclear wastes emitting large amounts of radiations of different types. Ritter specifies the employment of his particular high and low-Z materials whereas the present invention allows the use of a wide variety of such materials, for example, nuclear wastes include alpha and beta radiation emitters, but Ritter's device is limited to a source of gamma rays with less than 1 Mev power. Ritter tries to produce maximum voltage whereas such is not the purpose of this invention and in fact, preventing voltage build-up is very important. Ritter's invention is a "remote electrical generator" whereas the present apparatus is intended for use in or next to power plants, hospitals, waste processing centers or other places that generate or house nuclear wastes, and allows treatment of the wastes at such sites, thereby, at least in part, obviating the need to transport them to a dump. Finally, the Ritter patent makes no mention of consuming the energy developed in the load, especially one of variable resistance, which makes the apparatus adaptable for use with radioactive wastes of different strengths and of changing activities. Unlike the Ritter apparatus, which requires the regulation of the energy the radioactive source can emit so as to maintain it low, the present apparatus is capable of operations with high energy sources and is adaptable to consume whatever electrical energy is produced by such source, thereby aiding in continuous conversion of radiation to electrical energy.

The invention has been described with respect to various illustrations and embodiments thereof but is not to be limited to these because it is evident that one of skill in the art, with the present specification and drawings before him, will be able to utilize substitutes and equivalents without departing from the invention.

It is claimed:

1. An Apparatus for protecting organisms and the environment and preventing damage from harmful emissions of radiation from a source, said apparatus comprising:

first conductive shielding layer located in the path of emissions to absorb said emulsions from said radiation source, said first conductive shielding layer having a negative potential created by absorbing said emissions from said radiation source.

a first dielectric layer covering the outside of said first conductive shielding layer;

a second conductive shielding layer covering the outside said first dielectric layer, said second conductive shielding layer having a more positive potential, relative to said first conductive shielding layer, created by absorbing said emissions from said radiation source; and a circuit means including a battery, a diode for preventing a flow of current of said battery to said radiation source, conductive means for connecting said first conductive shielding layer and said second conductive shielding layer and a variable electrical loading means connected to said conductive means for controlling a current generated by the electrical potential difference between said first and second conductive shielding layers.

2. An apparatus according to claim 1 wherein said variable electriclal loading means is an automatically variable resistance.

3. An apparatus according to claim 1 wherein said radiation source emits Alpha rays and said first conductive shielding layer absorbs said Alpha rays.

4. An apparatus according to claim 1 wherein the first and second conductive shielding layers are used to contain the radiation source as in roughly spherical form, or cubic form.

5. An apparatus according to claim 1 wherein the apparatus is between the Source of radiation and the area to be protected.

6. An apparatus according to claim 1 wherein the Source is a source of heterogeneous nuclear wastes.

7. An apparatus according to claim 1 wherein the Source is radioactive material contained in mill-tailings, or nuclear devices, such as nuclear batteries, nuclear wastes, nuclear plants, decommisioned nuclear plants, or mixed wastes.

8. An apparatus according to claim 1 wherein the first and second conductive shielding layers are conductive material in the form of pure metals, alloys, or an amalgam including metals.

9. An apparatus according to claim 1 wherein the Source is a very small amount of nuclear wastes.

10. An apparatus according to claim 1 wherein the Source is harmful radiation and the first and second shielding layers are at least partially surrounding said harmful radiation source.

11. An apparatus according to claim 10 wherein said harmful radiation source is an organism source.

12. An apparatus according to claim 1 wherein the Source of harmful radiation is from Electrical power in Electrical and Electronic equipment.

13. An apparatus according to claim 1 wherein the conductive shielding layers are molded into the dielectric layer.

14. An apparatus according to claim 1 further comprising conductive shielding layers added to existing shielding.

15. An apparatus according to claim 1 wherein said potential difference is used to operate electric light.

16. An apparatus according to claim 1 wherein said conductive shielding layers are formed in a nuclear plant and are consuming at least some of the harmful radiation escaping from the radiation source.

17. An apparatus according to claim 1 wherein said variable electrical loading means has a negative end connected to said first conductive shielding layer which absorbs Alpha rays and a positive end connected to said second conductive shielding layer which absorbs Beta rays, wherein said Alpha rays and said Beta rays are emitted from said radiation source.

18. An apparatus for controlling harmful emissions of radiation, said apparatus comprising:

a radiation source for emitting harmful emissions;

a first electrically conductive shielding layer covering said radiation source, said first conductive shielding layer having a negative potential created by the emissions from said radiation source;

a dielectric layer covering the outside in contact with said first conductive shielding layer for electrically isolating said first conductive shielding layer;

a second electrically conductive shielding layer covering the outside in contact with said dielectric layer, said second conductive shielding layer having a positive potential created by the emissions from said radiation source; and a circuit means including a battery, a diode for preventing a flow of current of said battery to said radiation source, conductive means for connecting said first and second conductive shielding layers, and a variable electrical loading means connected to said conductive means for controlling a current generated by the electrical potential difference between said first and second conductive shielding layers.

19. An apparatus according to claim 18 wherein said harmful radiation source is liquid wastes.

* * * * *